US009831638B2

(12) United States Patent
Watanabe et al.

(10) Patent No.: US 9,831,638 B2
(45) Date of Patent: Nov. 28, 2017

(54) SPARK PLUG

(71) Applicant: DENSO CORPORATION, Kariya, Aichi-pref. (JP)

(72) Inventors: Tomoyuki Watanabe, Kariya (JP); Hiroshi Araki, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/473,685

(22) Filed: Mar. 30, 2017

(65) Prior Publication Data

US 2017/0288375 A1 Oct. 5, 2017

(30) Foreign Application Priority Data

Mar. 31, 2016 (JP) ..... 2016-070972

(51) Int. Cl.
*H01T 13/41* (2006.01)
*H01T 13/39* (2006.01)
*H01T 13/32* (2006.01)

(52) U.S. Cl.
CPC ..... *H01T 13/41* (2013.01); *H01T 13/32* (2013.01); *H01T 13/39* (2013.01)

(58) Field of Classification Search
CPC ..... H01T 13/41; H01T 13/32; H01T 13/39
See application file for complete search history.

(56) References Cited

U.S. PATENT DOCUMENTS 4,224,554 A * 9/1980 Nishio ..... H01T 13/41 123/633
6,160,342 A * 12/2000 Nishikawa ..... H01T 13/41 313/136
6,583,537 B1 * 6/2003 Honda ..... H01T 13/41 313/135
2006/0076865 A1 * 4/2006 Shibata ..... H01T 13/34 313/143

FOREIGN PATENT DOCUMENTS

JP 2006-066086 3/2006

* cited by examiner

*Primary Examiner* — Anne Hines
(74) *Attorney, Agent, or Firm* — Nixon & Vanderhye PC

(57) ABSTRACT

The spark plug has a shaft shaped center electrode, insulator, terminal fitting, ground electrode and resistor. The insulator has an axially penetrating shaft hole, and the center electrode is held in a tip end side of the shaft hole. The terminal fitting has a shaft and a terminal part. The shaft is held in a base end side of the shaft hole. The terminal part is projected from a base end of the shaft hole to a base end side of the spark plug. The ground electrode faces the center electrode in a tip end side of the shaft hole. The resistor is disposed between the center electrode and the terminal fitting in the shaft hole. An axial length L of the resistor is 15 mm≤L≤22.5 mm. An axial length T of the shaft satisfies a relation of 1.25≤T/L.

5 Claims, 5 Drawing Sheets

SPARK PLUG

CROSS-REFERENCE TO RELATED APPLICATION

This application is based on and claims the benefit of priority from earlier Japanese Patent Applications No. 2016-70972 filed on Mar. 31, 2016, the description of which is incorporated herein by reference.

TECHNICAL FIELD

This disclosure relates to a spark plug having a resistor between a center electrode and a terminal fitting.

BACKGROUND

A spark plug is used as ignition means of an internal combustion engine such as an automotive engine. In the spark plug, spark discharge is formed between a center electrode and a ground electrode. The center electrode is held in a shaft hole of the insulator. The ground electrode is fixed on a mounting bracket. The spark discharge is generated by applying a high voltage to the center electrode via a terminal fitting connected to a high-voltage source. In addition, a resistor is disposed between the center electrode and the terminal fitting for reducing radio noise. The radio noise is caused due to application of the high voltage.

Japanese Unexamined Patent Application Publication No. 2006-66086 will be referred to as patent document 1. In one instance, the followings are disclosed in patent document 1. In a shaft hole of the insulator, a resistor is disposed on a base end side of a center electrode. A distance between a tip end of the center electrode and a tip end of the resistor is set in a range of 10 mm to 20 mm. A diameter of the resistor is set in a range of 2.0 mm to 3.5 mm. In this way, a configuration satisfying both reduction of the radio noise and improvement of heat resistance is disclosed. In addition, an axial direction length of the resistor is 13 mm to 15 mm. Thereby, durability of the resistor is kept and noise suppressive performance (hereinafter referred to as a noise reduction property) is further improved. It is proposed that an axial direction length of a glass seal which contacts with the resistor is not more than 2 mm.

Recently, a discharge voltage generated in a spark discharge gap has tended to be increased. However, when the discharge voltage becomes high, a heat value of the resistor is increased. Thereby, oxidation of a conducting material making up the resistor is progressed, and degradation of the resistor tends to progress. Therefore, an increase in performance of the resistor at a higher required voltage is required.

In general, the length of the resistor needs to increase for improving the noise reduction property. However, when the length of the resistor is increased, a difficulty is found in that a density of the resistor becomes high during filling the resistor in the shaft hole. This leads to reduction of a load life. Therefore, as described in patent document 1, the axial direction length of the resistor is limited to be not more than 15 mm. In addition, the distance between the center electrode and the resistor and the axial direction length of the glass seal and the like are pre-determined. The center electrode is held in the shaft hole of the insulator. In this way, the density of the resistor needs to be suppressed from being reduced.

SUMMARY

Embodiment provides a high-integrity spark plug for which a noise suppressive performance (hereinafter referred to as a noise reduction property) is improved in an ignition at a higher required voltage, which is capable of securing a load life.

In one aspect of the present disclosure, a spark plug has a center electrode, insulator, shaft, terminal fitting, ground electrode and resistor. The center electrode has an elongated shaft shape. The insulator has a shaft hole penetrating in an axial direction. The center electrode is held in the shaft hole of a tip end side of the insulator. The shaft is held in the shaft hole of a base end side of the insulator. The terminal fitting has a terminal part projected from a base end of the shaft hole to a base end side of the spark plug in the axial direction. The ground electrode faces the center electrode in a tip end side of the shaft hole. The resistor is disposed between the center electrode and the terminal fitting in the shaft hole.

A length L of the resistor in the axial direction is 15 mm or more and 22.5 mm or less. A length T of the shaft in the axial direction and the length L of the resistor are in a relation of $1.25 \leq T/L$.

According to the above-described configuration of the spark plug, the length L of the resistor is 15 mm to 22.5 mm, and the noise reduction property can be further improved. In addition, the length T of the shaft of the terminal fitting held in the insulator is increased relative to the length L of the resistor. Especially, when T/L is not less than 1.25, the resistor may be sufficiently compressed using the terminal fitting when assembling the spark plug. The length L of the resistor is within the above-described range. Thereby, a density of the resistor may be sufficiently increased.

Accordingly, in the ignition at the higher required voltage, an improvement of the noise reduction property and securement of the load life can be compatibly established. Therefore, the high-integrity spark plug may be obtained.

DETAILED DESCRIPTION OF THE PREFERRED EMBODIMENTS

First Embodiment

Figure 1:
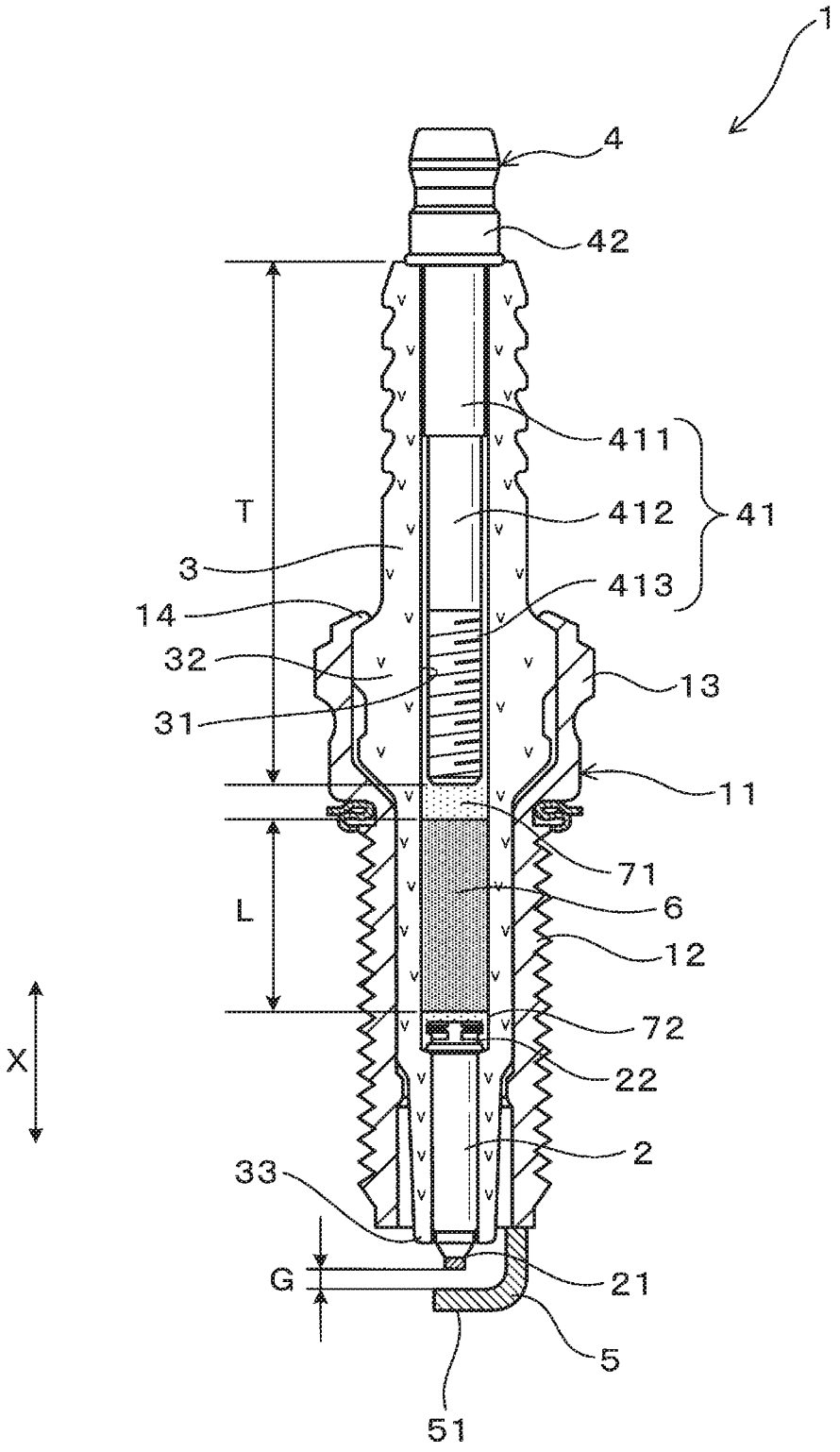
FIG. 1 shows a longitudinal sectional view of an overall configuration of a spark plug according to a first embodiment.

A first embodiment related to a spark plug for an internal combustion engine is described by referring to drawings. As shown in FIG. 1, a spark plug 1 has a center electrode 2, an insulator 3, a terminal fitting 4, a ground electrode and a resistor. The center electrode 2 has an elongated shaft shape. The insulator 3 has a shaft hole 31, and the center electrode 2 is held in the shaft hole 31 of a tip end side of the insulator 3. The terminal fitting 4 holds a shaft 41 in a base end side of the shaft hole 31. The ground electrode 5 faces the center electrode 2 in a tip end side of the shaft hole 31. The resistor 6 is disposed between the center electrode 2 and the terminal fitting 4 in the shaft hole 31. In the spark plug 1, an axial direction of the center electrode 2 and the insulator 3 disposed concentrically is defined as a vertical direction of FIG. 1. In addition, the shaft hole 31 is disposed so as to penetrate through the insulator 3 in the axial direction X. In the shaft hole 31, a lower side of FIG. 1 is a tip end side of the spark plug 1 which holds the center electrode 2. In addition, an upper side of FIG. 1 is a base end side of the spark plug 1 which holds the terminal fitting 4.

The insulator 3 is held in a cylindrical mounting bracket 11. The terminal fitting 4 has a terminal part 42 projected from a base end of the shaft hole 31 to the base end side of the spark plug 1 in the axial direction X. A length L of the resistor 6 in the axial direction X is 15 mm or more and 22.5 mm or less. A length T of the shaft 41 in the axial direction X and the length L of the resistor are in a relation of $1.25 \leq T/L$. Conductive seal layers 71 and 72 are disposed so as to contact with the resistor 6.

Details of each part are described below.

The internal combustion engine is, for example, an engine for automobiles. The spark plug 1 is mounted to a mounting hole (not shown) of a cylinder head facing an engine combustion chamber using the mounting bracket 11. A mounting screw 12 is disposed on an outer periphery of a tip end side half portion of the mounting bracket 11. A large-diameter part 13 whose external diameter is larger than an external diameter of the mounting screw 12 is a base end side half portion of the mounting bracket 11. A large-diameter part 32 is held in an intermediate part of the insulator 3 in the large-diameter part 13. A base end edge 14 of the large-diameter part 13 is re-tightened and fixed to the large-diameter part 32. Thereby, the large-diameter part 32 is airtightly sealed. The mounting bracket 11 is, for example, made of an iron alloy material such as carbon steel. The insulator 3 is, for example, made of an insulating ceramic material such as an alumina.

A tip end part 33 of the insulator 3 is projected from a tip opening of the mounting bracket 11 to the tip end side of the spark plug 1. An external diameter of a base end tip part 22 of the center electrode is larger than that of the center electrode 2. The base end tip part 22 is supported on a tapered shoulder surface disposed on an inner periphery of the shaft hole 31. A tapered tip end part 21 is projected from the tip end part 33 of the insulator 3 to the tip end side of the spark plug 1. The whole of the ground electrode 5 has a plate shape body and is bent in an L shape. The base end side of the ground electrode 5 is joined and fixed to a tip end surface of the mounting bracket 11. An axial direction X of the spark plug 1 is defined as a center axis. The ground electrode 5 is extended from the mounting bracket 11 to the tip end side of the spark plug 1 in the axial direction X. The ground electrode 5 on the tip end side from the tip end part 21 is bent toward the center axis A and extends in a direction perpendicular to the center axis A. The tip end side of the ground electrode 5 faces the tip end part 21 of the center electrode 2. Thereby, a spark discharge gap G is formed between the tip end part 21 of the center electrode 2 and a tip end part 51 of the ground electrode 5.

The center electrode 2 and the ground electrode 5 are, for example, made of a metal material such as a Ni-based alloy mainly including Ni (i.e. nickel). The metal material is used as a base material. A core made of a metal having excellent heat conductivity such as, for example, Cu (i.e. copper) or Cu alloy, may be disposed inside the center electrode 2 and the ground electrode 5. Opposing surfaces of the tip end part 21 of the center electrode 2 and the tip end part 51 of the ground electrode 5 are joined to a noble metal tip by welding. The noble metal tip has, for example, a cylindrical shape. A noble metal material may include, for example, Pt (i.e. platinum), Ir (i.e. iridium) Rh (i.e. rhodium) or the like. A noble metal or a noble metal alloy including at least one of these noble metals as a main component may be used.

Figure 2:
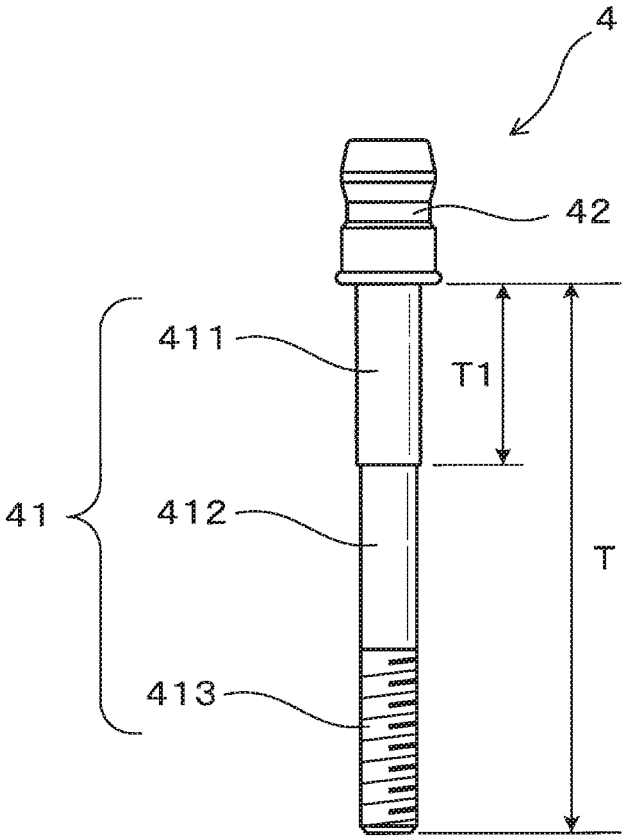
FIG. 2 shows a configuration of a terminal fitting of the spark plug according to the first embodiment.

As shown in FIG. 2, the terminal fitting 4 has the terminal part 42 and the shaft 41. A diameter of the terminal part 42 is larger than that of the terminal fitting 4. A diameter of the shaft is larger than that of the terminal fitting 4. The shaft 41 is made up of a base end part 411 and a main shaft 412. The base end part 411 is disposed on a side of the terminal part 42. The main shaft 412 is disposed on the tip end side from the base end part 411. The main shaft 412 has an outer peripheral groove 413. Screw machining or grooving work is applied to an outer periphery of the tip end side of the outer peripheral groove 413. This improves a fixing strength of the first conductive seal layer 71 between the resistor 6 and the outer peripheral groove 413. As shown in FIG. 1, the shaft 51 is held in the shaft hole 31. The resistor 6 is pressured using the terminal fitting 4 via the first conductive seal layer 71 when the terminal fitting 4 is assembled into the insulator 3. The terminal part 42 of the terminal fitting 4 is projected from a base opening of the shaft hole 31 to the base end side of the spark plug 1. In addition, the terminal part 42 is connected with the high-voltage source (not shown). The high-voltage source is, for example, an ignition coil which is connected with a vehicle mounted battery and which generates a high voltage for ignition. The high-voltage source is connected with a control device (not shown).

In the shaft hole 31, the resistor 6 is disposed between the shaft 41 of the terminal fitting 4 and the center electrode 2 via the conductive seal layers 71 and 72. The resistor 6 is a cylindrical material including conductive material. In addition, the resistor 6 is adjusted to a predetermined level of resistance. The resistor 6 electrically connects the center electrode 2 with the terminal fitting 4 and has a function of reducing radio noise. The resistor 6 is, for example, made up of an aggregate including a substrate including a filled material and a glass material such as a borosilicate glass added with the conductive material such as a carbon material. Specifically, the aggregate may be obtained by heat disposal powder materials including powder of the conductive material and glass powder and filled material powder. For example, ceramic powder such as zirconia powder is used as the filled material powder. In addition, for example, carbon-glass mixed powder mainly including a glass mixed with carbon powder may be used as the powder of the conductive material.

The first conductive seal layer 71 is filled between the resistor 6 and the terminal fitting 4. The second conductive seal layer 72 is filled between the resistor 6 and the center electrode 2. The first and the second conductive seal layers 71, 72 include a conductive joining glass. The joining glass includes, for example, a copper glass which is made up of copper powder mixed with a glass. Thereby, a conductive path is formed from the external high-voltage source to the center electrode 2 via the terminal fitting 4, the first conductive seal layer 71, the resistor 6 and the second conductive seal layer 72. The high voltage is applied between the center electrode 2 and the ground electrode 5, and spark discharge is then generated.

The length L of the resistor 6 in the axial direction X is 15 mm or more and 22.5 mm or less. The length L of the resistor 6 is a distance between an end face of the base end side of the resistor 6 and an end face of the tip end side of the resistor 6 in the axial direction X. The end face of the base end side of the resistor 6 is contacted with the first conductive seal layer 71. The end face of the tip end side of the resistor 6 is contacted with the second conductive seal layer 72. When the length L of the resistor 6 is less than 15 mm and is over 22.5 mm, the resistance level of the resistor 6 is easily increased due to heat generation. The heat is generated when a discharge voltage is increased. This may reduce a load life. When the length L of the resistor 6 is not less than 15 mm, joule heat generation due to energization is reduced. When the length L of the resistor 6 is not more than 22.5 mm, a current depending on an electrostatic capacitance of the own resistor 6 is reduced. A change of the resistance level of the resistor 6 is restrained within a predetermined range. Thereby, the load life may be improved. An external diameter D of the resistor 6 may be, for example, 2 mm to 4 mm.

A mechanism of degradation of the resistor 6 due to ignition of the spark plug 1 is considered below. That is, when the high voltage is applied to the spark discharge gap G and the spark discharge is then generated, the current flows through the conductive path. Specifically, the current flows from the terminal fitting 4 to the center electrode 2 via the resistor 6. Then, joule heat is generated inside of the resistor 6. Oxidation of carbon as the conductive material occurs with the heat generation, and the conductivity of the carbon is decreased gradually. Thereby, a part of the conductive path inside the resistor 6 disappears. Therefore, the resistance level of the resistor 6 is increased gradually, and the spark discharge misfires. A heat quantity Q generated by the joule heat is shown in formula 1 below. As shown in formula 1, a decreasing of a current I and the heat quantity Q is effective for a reduction of the degradation of the resistor 6.

$$Q=RI^2t \qquad \text{Formula 1:}$$

In the formula, Q: heat quantity (unit: J), R: resistance level (unit: kΩ), I: current (unit: A), t: energizing time (unit: s)

In addition, at the time of the ignition of the spark plug 1, a relation between the current 1 and a voltage Vx per unit length and the length L of the resistor 6 is generally shown in formula 2 and formula 3. The current I flows through the resistor 6.

$$I=Vx/R\text{all} \qquad \text{Formula 2:}$$

$$Vx=V\text{all}/L \qquad \text{Formula 3:}$$

In the formula, I: current (unit: A), Vx: voltage per unit length (unit: kV), Rall: overall resistance level (unit: kΩ), Vall: voltage applied to the whole of the resistor (unit: kV), L: length of the resistor (unit: mm)

In short, as the length L of the resistor 6 becomes longer, the voltage Vx per unit length may be decreased. Therefore, the current I which flows through the resistor 6 may be decreased. Accordingly, when the length L of the resistor 6 is not less than 15 mm, the load life may be improved.

Figure 3:
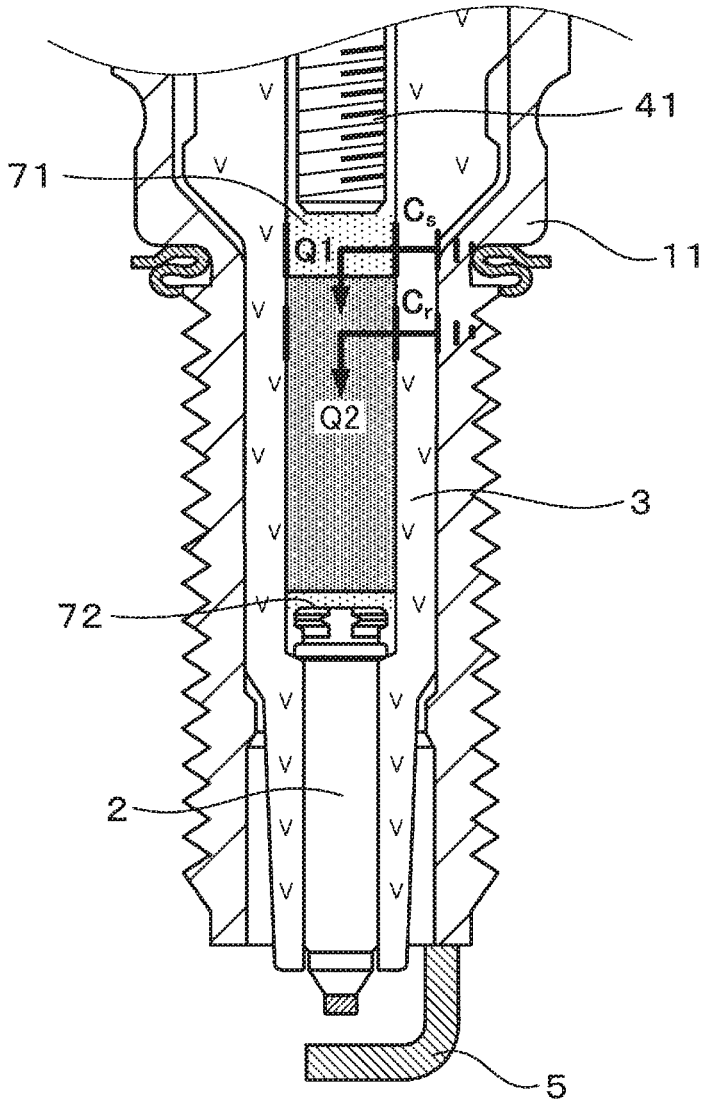
FIG. 3 shows the longitudinal sectional view of a main part of the spark plug and a typical view of a relation between a capacitance and a charge which flows through a resistor at the time of discharge of the spark plug according to the first embodiment.

As shown in FIG. 3, an electrostatic capacitance Cr exists in the resistor 6 which is insulated and held inside the insulator 3. Therefore, a charge Q2 depending on the electrostatic capacitance Cr flows through the resistor 6 at the time of discharge of the spark plug. Then, an electrostatic capacitance Cs exists on the base end side from the resistor 6. At the same time as the charge Q2, a stored charge Q1 flows through the resistor 6. A relation between the electrostatic capacitances Cr, Cs and the charges Q1, Q2 is generally shown in formula 4 and formula 5.

$$(Q1,Q2)=(Cr,Cs)\times V \qquad \text{Formula 4:}$$

$$I=d(Q1,Q2)/dt \qquad \text{Formula 5:}$$

In the formula, Q1, Q2: charge (unit: C), Cr, Cs: electrostatic capacitance (unit: F), V: voltage (unit: V), I: current (unit: A), t: time (unit: s)

The electrostatic capacitance Cr inside the resistor 6 becomes higher as a conductive part is increased and a resistivity p is decreased. A relation between the overall resistance level Rall of the resistor 6 and the resistivity p and the length L of the resistor 6 is shown in formula 6. That is, when the overall resistance level Rall is a constant value, the resistivity p is required to be decreased in order that the length L of the resistor 6 becomes long.

$$R\text{all}=p\times(L/S) \qquad \text{Formula:}$$

In the formula, Rall: overall resistance level (unit: kΩ), p: resistivity (unit: kΩ·mm), L: length (unit: mm), S: cross-section area (unit: $mm^2$)

In this case, the electrostatic capacitance Cr inside the resistor 6 becomes higher as the resistivity p is decreased. In proportion to increasing the electrostatic capacitance Cr, the current I which flows through the resistor 6 becomes increased. Therefore, when the length L of the resistor 6 is over 22.5 mm, the voltage Vx per unit length does not become decreased. Thereby, the load life may not be improved. Accordingly, the length L of the resistor 6 may be 15 mm to 22.5 mm, or preferably, 15.5 mm≤L≤21.5 mm. An improvement of the noise reduction property and a securement of the load life can be compatibly established.

To obtain these effects, it needs to sufficiently increase a density of the resistor 6. Therefore, in FIG. 1, a ratio T/L may be 1.25≤T/L, or preferably 1.29≤T/L≤2.6. T (unit: mm) is the length of the shaft 41 of the terminal fitting 4 in the axial direction X. L is the length of the resistor 6. In FIG. 2, the length T of the shaft 41 is a distance between an end face of the tip end side of the terminal part 42 and an end face of the tip end side of the main shaft 412 in the axial direction X. The end face of the tip end side of the terminal part 42 is contacted with the base end part 411. The terminal fitting 4 may be, for example, made of an iron alloy material such as carbon steel. The terminal fitting 4 may be desired to use a material with relatively high hardness. Therefore, the terminal fitting 4 is not bent when the terminal fitting 4 is assembled into the insulator 3, and pressure transference to the resistor 6 may be improved. In addition, the pressure transference to the resistor 6 may also be improved by changing a pitch or a depth of a screw or a groove in the outer peripheral groove 413 of the main shaft 412.

An external diameter of the base end part 411 is preferred to be larger in a range that penetrability to the shaft 31 may be secured. Thereby, a resistance force relative to bending becomes increased, and the pressure transference to the resistor 6 may be improved. Preferably, the external diameter of the base end part 411 is the same as the external diameter D of the resistor 6. For example, the external diameter of the base end part 411 may be 2 mm to 4 mm. In addition, a length T1 of the base end part 411 in the axial direction X is preferred to be longer to improve the pressure transference to the resistor 6. For example, the length T1 of the base end part 411 may be set to be a quarter or more of the length T of the shaft 41, or preferably a third to a half of the length T of the shaft 41.

Figure 4:
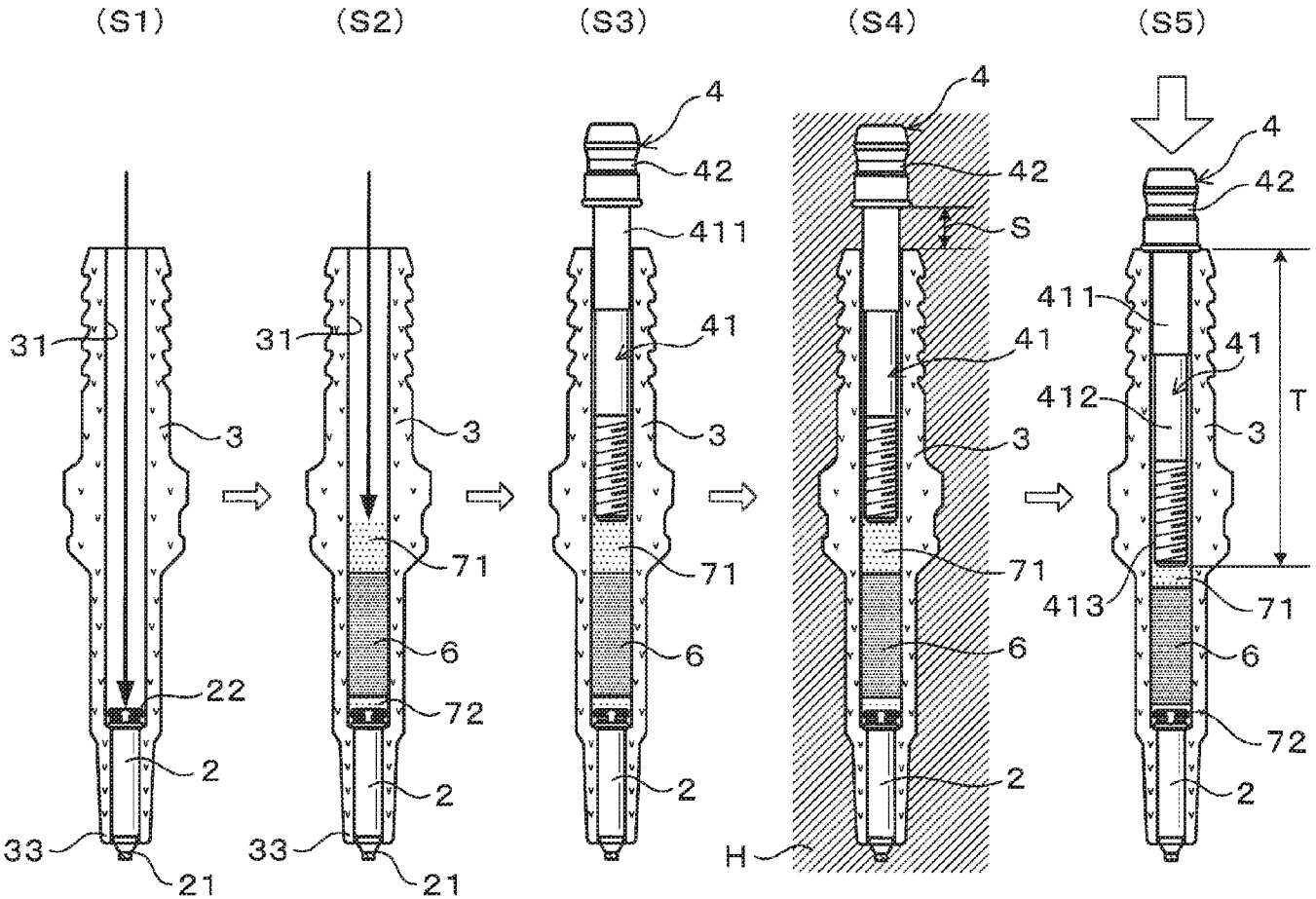
FIG. 4 shows an assembling process diagram of a method of producing the spark plug in a sub-assembly state according to the first embodiment.

As shown in FIG. 4, the resistor 6 is compressed by pressure in a process wherein the terminal fitting 4 is assembled into the insulator 3. Therefore, the length T is set so that the ratio T/L is 1.25 or more. Thereby, a stroke amount of the terminal fitting 4 may be sufficiently increased, and welding pressure may be applied to the resistor 6. Thereby, the density of the resistor 6 is sufficiently increased, and the conductive path is evenly formed in the resistor 6. Thereby, the degradation of the resistor 6 is reduced. The ratio T/L is preferred to be 1.29 or more. The load life is further improved with an increase in the ratio T/L. However, when the ratio T/L is over 2.0, the load life is difficult to be improved. Accordingly, the ratio T/L is preferred to be not more than 2.6.

Next, in FIG. 4, the center electrode 2, the resistor 6 and the terminal fitting 4 are assembled into the insulator 3, and a method of producing the spark plug of sub-assembly is described below. First, in a first process S1, the center electrode 2 is inserted into the shaft hole 31 of the insulator 3. The tip end part 21 of the center electrode is projected from the tip end part 33 of the insulator 3 to the tip end side of a spark plug in the first process S1. The base end tip part 22 of the center electrode 2 is supported on the tapered shoulder surface disposed on the inner periphery of the shaft hole 31. Next, in a second process S2, copper glass powder which becomes the second conductive seal layer 72, the carbon-glass mixed powder which becomes the resistor 6 and copper glass powder which becomes the first conductive seal layer 71 are sequentially inserted into the shaft hole 31. In a third process S3, the shaft 41 of the terminal fitting 4 is inserted from the base end side of a spark plug in the second process S3 into the shaft hole 31 so as to be disposed on the first conductive seal layer 71.

Then, in the shaft 41 of the terminal fitting 4, a diameter of the main shaft 412 is smaller than that of the base end part 411. Therefore, the shaft 41 is smoothly inserted into the shaft hole 31 and is contacted with a surface of the base end side of the first conductive seal layer 71. In addition, the base end part 411 acts as a guide and reduces bending of the spark plug 1. In this state, a part of the base end part 411 and the terminal part 42 are projected from the base end side of the shaft hole 31 to the base end side of the spark plug in the second process S3. By lengthening the shaft hole 31 of the base end part 411.

Next, in a fourth process S4, the spark plug in the second process S3 is heated in a baking furnace H at a temperature not lower than a softening temperature of glass materials. In this process, the glass materials which become the resistor 6, the first and the second conductive seal layers 71, 72 are softened and become flowable. In this state, the length of the shaft 41 projected from the shaft hole 31 becomes a stroke amount S in a fifth process S5 following the fourth process S4. In the fifth process S5, the terminal part 42 of the terminal fitting 4 is pressured toward the tip end side of a spark plug in the fifth process S5 using a press apparatus (not shown). In addition, the terminal part 42 is pressured in an axial direction of the spark plug in the fifth process S5. Thereby, as shown by an arrow in FIG. 4, the whole of the shaft 41 is inserted into the shaft hole 31. In this process, the glass material which becomes the second conductive seal layer 72 flows from the tip end side of the main shaft 412 of the terminal fitting 4 to the outer peripheral groove 413. The terminal fitting 4 transfers the welding pressure to the resistor 6 and the second conductive seal layer via the first conductive seal layer 71. Thereby the resistor 6 is compressed. A thickness of the first conductive seal layer 71 in the axial direction X is approximately 1 mm to 3 mm.

After that, a spark plug in the fifth process S5 is cooled, and the main shaft 412 of the terminal fitting 4 is fixed into the shaft hole 31 using the first conductive seal layer 71. Then, the first conductive seal layer 71 easily creeps up around the main shaft 412 along the outer periphery groove 413 of the main shaft 412. The pressure transference from the terminal fitting 4 to the resistor 6 is improved while improving fixing property of the first conductive seal layer 71 into the shaft hole 31. The ratio T/L of the length T of the shaft 41 to the length L of the resistor 6 is set not to less than 1.25. In addition, the stroke amount S is sufficiently long. Therefore, the good pressure transference from the terminal fitting 4 enables the resistor 6 to be sufficiently compressed, and the density of the resistor 6 may be improved.

Accordingly, even if the length of the resistor 6 is lengthened, the high density of the resistor 6 may be kept, and the load life of the resistor 6 may be improved.

Embodiment

In a configuration of the spark plug 1 shown in FIG. 1, the following various embodiments and comparative examples are embodiments and comparative examples which respectively change the length T of the shaft 41 of the terminal fitting 4 and the length L of the resistor 6. A load life test was conducted and the various embodiments and comparative examples were evaluated below.

Embodiments 1 to 11

A spark plug in a sub-assembly state was produced by the assembly process of the spark plug shown in FIG. 4. In addition, the whole of the spark plug in a sub-assembly state was inserted into a mounting bracket 11. In addition, a base end edge 14 was re-tightened and fixed to the spark plug in the sub-assembly state. Thereby, a spark plug 1 was produced. In the spark plug 1, a length L of a resistor 6 in an axial direction X was set to 15.5 mm. The length T of a shaft 41 of a terminal fitting 4 was changed in a range of 20.0 mm to 40.0 mm. An external diameter D of the resistor 6 was 3 mm, and has a predetermined shape. Carbon-glass mixed powder which becomes the resistor 6 was adjusted so that an overall resistance level is 5 kΩ. The terminal fitting 4 is made up of steel with a hardness of 100 Hv (i.e. Vickers hardness). A length of a base end part 411 of the shaft 41 is 10 mm.

The spark plugs 1 of an embodiment 1 to an embodiment 11 are respectively applied to an engine bench system. Then, an accelerated test is conducted under a condition shown in Table 1. The present test condition is based on JISB8031. A discharge voltage and a temperature conditions are respectively 35 kV and 350° C. These conditions are more stricter than conditions of JISB8031 (i.e. 20±5 kV, no predetermined temperature). In addition, an ignition number is a number of times until a resistance changing rate reaches 30%. This is based on the resistance changing rate being not more than 30% according to the standard of JISB8031. Incidentally, the ignition number 13000000 in JISB8031 corresponds to 40 hours at a 100 Hz frequency of the present test condition. Therefore, in the present test, a time until the resistance changing ratio reaches 30% is used as a load life time. A standard of the present test condition is set to be that the load life time is not less than 40 hours. The results were shown in Table 2.

TABLE 1

| Test Condition | Accelerate Test | JISB8031 |
|---|---|---|
| Ignition Number (Time) | Until Reaching 30% Resistance change ratio | 13000000 |
| Frequency | 100 Hz | No Standard |
| Discharge Voltage | 35 kV | 20 ± 5 kV |
| Temperature | 350° C. | No Standard |
| Standard | Not Less Than 40 Hours Of A Load Life Time | Not More Than 30% Resistance change |

TABLE 2

| Embodiment No. Comparative Example No. | L (mm) | T (mm) | T/L | T + L | Resistance Level (k'Ω) | D (mm) | Load Life Time (h) |
|---|---|---|---|---|---|---|---|
| Comparative Example 1 | 15.5 | 16 | 1.03 | 31.5 | 5 | 3 | 15 |
| Comparative Example 2 | 15.5 | 18 | 1.16 | 33.5 | 5 | 3 | 25 |
| Embodiment 1 | 15.5 | 20 | 1.29 | 35.5 | 5 | 3 | 45 |
| Embodiment 2 | 15.5 | 22 | 1.42 | 37.5 | 5 | 3 | 50 |
| Embodiment 3 | 15.5 | 24 | 1.55 | 39.5 | 5 | 3 | 55 |
| Embodiment 4 | 15.5 | 26 | 1.68 | 41.5 | 5 | 3 | 55 |
| Embodiment 5 | 15.5 | 28 | 1.81 | 43.5 | 5 | 3 | 65 |
| Embodiment 6 | 15.5 | 30 | 1.94 | 45.5 | 5 | 3 | 65 |
| Embodiment 7 | 15.5 | 32 | 2.06 | 47.5 | 5 | 3 | 70 |
| Embodiment 8 | 15.5 | 34 | 2.19 | 49.5 | 5 | 3 | 70 |
| Embodiment 9 | 15.5 | 36 | 2.32 | 51.5 | 5 | 3 | 70 |
| Embodiment 10 | 15.5 | 38 | 2.45 | 53.5 | 5 | 3 | 70 |
| Embodiment 11 | 15.5 | 40 | 2.58 | 55.5 | 5 | 3 | 75 |

Comparative Example 1 to 2

A spark plug 1 was manufactured in the same way as in the embodiment 1. In addition, an accelerated test was conducted and was evaluated in the same way as in the embodiment 1. In the spark plug 1, a length L of a resistor 6 in an axial direction X was 15.5 mm. A length T of a terminal fitting 4 of a shaft 41 was 16.0 mm and 18.0 mm. The results were shown in Table 2.

Figure 5:
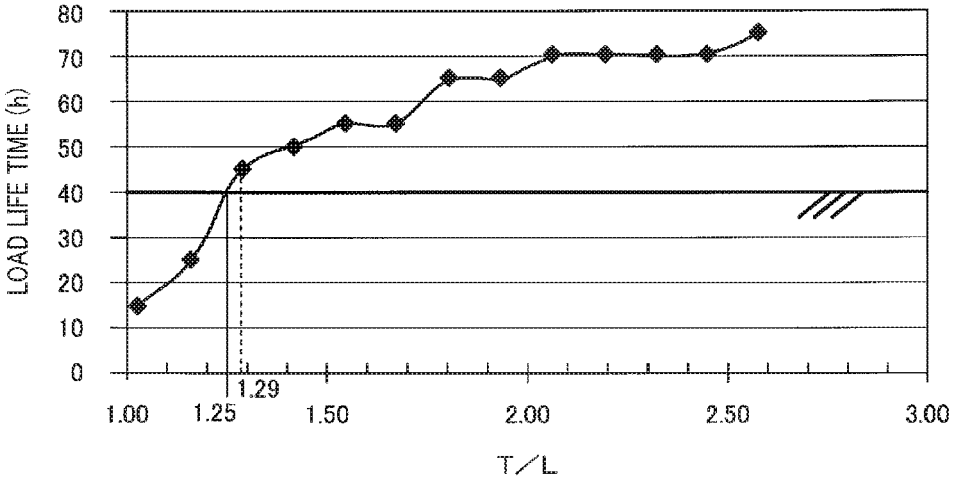
FIG. 5 shows a graph of a relation between a ratio T/L and a load life time, and T is a length of a shaft of a terminal fitting, and L is a length of the resistor according to the first embodiment.

As shown in Table 2, the length L of each of embodiments 1 to 11 was 15.5 mm (i.e. 15 mm≤L≤22.5 mm). Each of embodiments 1 to 11 of which a ratio T/L to the length T of the shaft 41 of the terminal fitting 4 was 1.29 to 2.58, and each had a load life time of over 40 hours. The load life time became longer with an increase in the ratio T/L. However, each of comparative examples 1 to 2 whose ratio T/L was 1.16 or less, and each had a load life time of 25 hours or less. The length L of the comparative examples 1 to 2 was 15.5 mm. In addition, as shown in FIG. 5 based on Table 2, when the ratio T/L is 1.25 or more, the load life time reached 40 hours.

Accordingly, the ratio T/L may be 1.25≤T/L, or preferably 1.25≤T/L≤2.6.

Embodiments 12 to 16

A spark plug 1 was produced in the same way as in the embodiment 1. In addition, an accelerated test was conducted and was evaluated in the same way as in embodiment 1. In the spark plug 1, a length L of a resistor 6 in an axial direction X was changed in a range of 15.5 mm to 21.5 mm. A length T of a terminal fitting 4 of a shaft 41 was set so that a ratio T/L is 1.29. The results were shown in Table 3.

TABLE 3

| Embodiment No. Comparative Example No. | L (mm) | T (mm) | T/L | Resistance Level (k'Ω) | D (mm) | Load Life Time (h) |
|---|---|---|---|---|---|---|
| Comparative Example 3 | 14 | 18.1 | 1.29 | 5 | 3 | 25 |
| Embodiment 12 | 15.5 | 20 | 1.29 | 5 | 3 | 45 |
| Embodiment 13 | 17 | 21.9 | 1.29 | 5 | 3 | 60 |
| Embodiment 14 | 18.5 | 23.9 | 1.29 | 5 | 3 | 65 |
| Embodiment 15 | 20 | 25.8 | 1.29 | 5 | 3 | 60 |
| Embodiment 16 | 21.5 | 27.7 | 1.29 | 5 | 3 | 50 |
| Comparative Example 4 | 23 | 29.7 | 1.29 | 5 | 3 | 35 |
| Comparative Example 5 | 24.5 | 31.6 | 1.29 | 5 | 3 | 30 |

Comparative Examples 3 to 5

A spark plug 1 was produced in the same way as in embodiment 1. In addition, an accelerated test was conducted and was evaluated in the same way as in embodiment 1. In the spark plug 1, a length L of a resistor 6 in an axial direction X was 14 mm, 23 mm and 24.5 mm. The length T of a terminal fitting 4 of a shaft 41 was set to be so that a ratio T/L is 1.29. The results were shown in Table 3.

Figure 6:
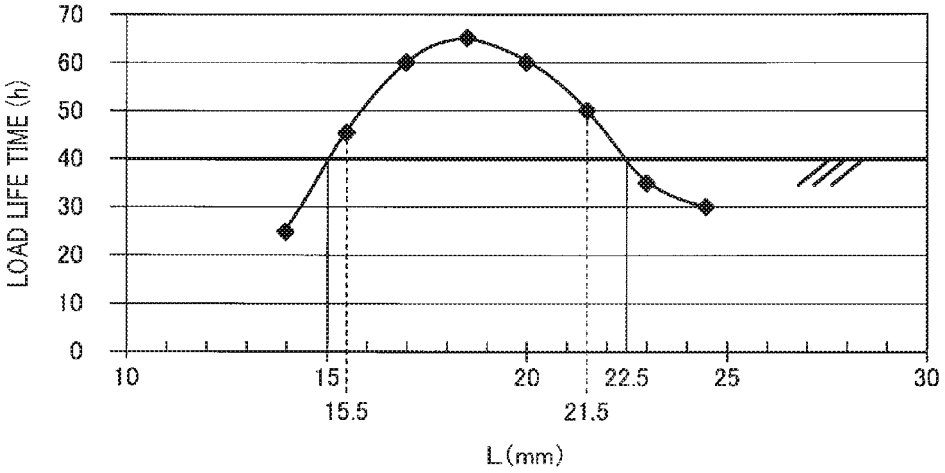
FIG. 6 shows a graph of a relation between the length L of the resistor and the load life time.

As shown in Table 3, the ratio T/L of each of embodiments 12 to 16 was 1.29 (i.e. 1.25≤T/L). Each of embodiments 12 to 16, whose length L was 15.5 mm to 21.5 mm, had a load life time of over 40 hours. However, each of comparative examples 3 to 5 whose length L was 14 mm or less or 23 mm or more, had a load life time of 35 hours or less. The ratio T/L of each of the comparative examples 3 to 5 was 1.29 (i.e. 1.25≤T/L). In addition, as shown in FIG. 6 based on Table 2, when the length L is 15 mm or more, the load life time is 40 hours or more. The load life time gradually increases until the length L reaches approximately 18 mm. When the length L is over approximately 18 mm to 22.5 mm, the load life gradually decreases. When the length L is over 22.5 mm, the load life is under 40 hours.

Accordingly, the length L of the resistor 6 may be 15 mm≤L≤22.5 mm, or preferably 15.5 mm≤L≤21.5 mm. Incidentally, in the embodiments and the comparative examples, the present test was conducted so that the thickness of a first conductive seal layer 71 is approximately 2 mm The present disclosure is not intended to be limited to embodiments, but may be altered within the scope of the claims. For example, a shape and a material of an each part of the spark plug 1 may be appropriately changed without limiting embodiments. In addition, in the internal combustion engine, an example of an application of the engine for the automobiles was described. However, the internal combustion engine may be also certainly applied to an internal combustion engine such as a cogeneration system without being limited to automobiles.

What is claimed is:

1. A spark plug comprising:

a center electrode which has an elongated shaft shape;

an insulator which has a shaft hole penetrated therein in an axial direction, and the center electrode is held in a tip end side of the shaft hole;

a terminal fitting which has a shaft and a terminal part, and the shaft is held in a base end side in the shaft hole, and the terminal part is projected from a base end of the shaft hole to a base end side of the spark plug in the axial direction;

a ground electrode which faces the center electrode in the tip end side of the shaft hole; and a resistor which is disposed between the center electrode and the terminal fitting in the shaft hole, wherein a length L of the resistor in the axial direction is 15 mm≤L≤22.5 mm, wherein a length T of the shaft in the axial direction and the length L of the resistor are in a relation of 1.25≤T/L.

2. The spark plug as set forth in claim 1, wherein the length L of the resistor is 15.5 mm≤L≤21.5 mm.

3. The spark plug as set forth in claim 1, wherein the length T of the shaft and the length L of the resistor are in a relation of 1.29≤T/L≤2.6.

4. The spark plug as set forth in claim 1, wherein the resistor includes a substrate to which a conductive material is added; and the substrate includes a filled material and a glass material.

5. The spark plug as set forth in claim 4, wherein the conductive material includes carbon.

* * * * *